United States Patent [19]

Gilreath

[11] 4,168,423

[45] Sep. 18, 1979

[54] SUPPORT LEG FOR THE BAKE ELEMENT OF AN ELECTRIC OVEN

[75] Inventor: Robert V. Gilreath, Cookeville, Tenn.

[73] Assignee: Teledyne Still-Man Manufacturing, Cookeville, Tenn.

[21] Appl. No.: 787,010

[22] Filed: Apr. 13, 1977

Related U.S. Application Data

[63] Continuation of Ser. No. 595,536, Jul. 14, 1975, abandoned.

[51] Int. Cl.[2] ..... H05B 3/66; A44B 21/00

[52] U.S. Cl. ..... 219/402; 24/81 B; 219/536; 219/542; 219/546; 248/74 A

[58] Field of Search ..... 219/391, 392, 400–402, 219/544, 536; 24/81 B, 129 B, 257 R, 81 LC, 735 A, 257 A, 259 C, 81 CC; 248/74 R, 74 A, 74 B, 49; 174/161 F, 163 F

[56] References Cited

U.S. PATENT DOCUMENTS

| | | | |
|---|---|---|---|
| 2,608,766 | 9/1952 | Thein | 24/257 R |
| 2,875,313 | 2/1959 | King | 219/544 |
| 2,923,385 | 2/1960 | Tinwerman | 403/20 |
| 2,930,881 | 3/1960 | Ammerman | 219/403 |
| 3,071,640 | 1/1963 | Langlie et al. | 174/161 F |
| 3,295,812 | 1/1967 | Schneider et al. | 24/81 LC |
| 3,497,923 | 3/1970 | Seckerson | 24/81 B |
| 3,594,682 | 7/1971 | Oleson | 24/81 B |
| 3,752,902 | 8/1973 | Wilson | 174/163 F |

FOREIGN PATENT DOCUMENTS

| | | | |
|---|---|---|---|
| 478356 | 11/1951 | Canada | 174/161 F |

*Primary Examiner*—Roy N. Envall, Jr.
*Assistant Examiner*—Bernard Roskoski
*Attorney, Agent, or Firm*—Marn & Jangarathis

[57] ABSTRACT

There is disclosed a support leg for a heating element of an electric unit including vertically extending arm members including inwardly extending teeth members which firmly engage the outer surface of the heating element in a manner to prevent subsequent rotation of such support leg.

3 Claims, 7 Drawing Figures

FIG. 4
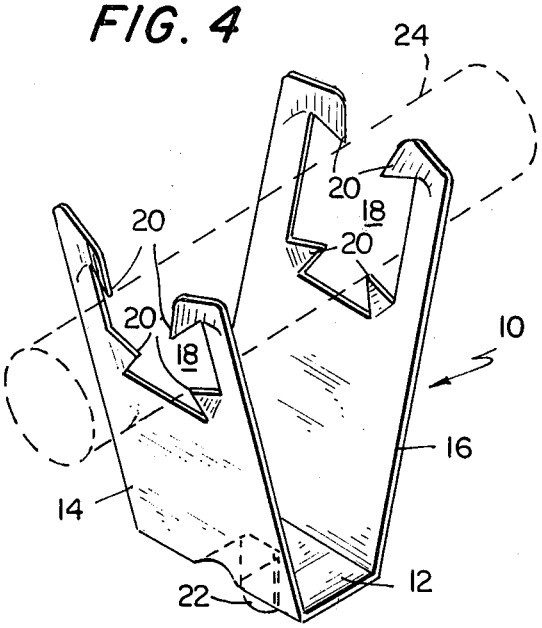
FIG. 1
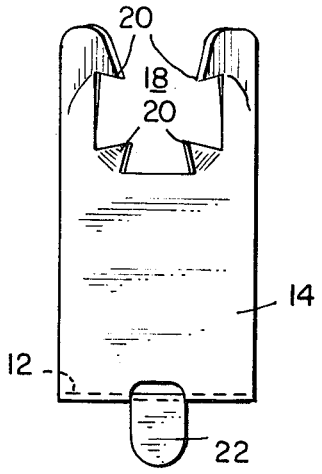
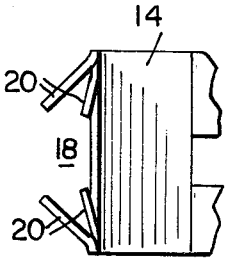
FIG. 3
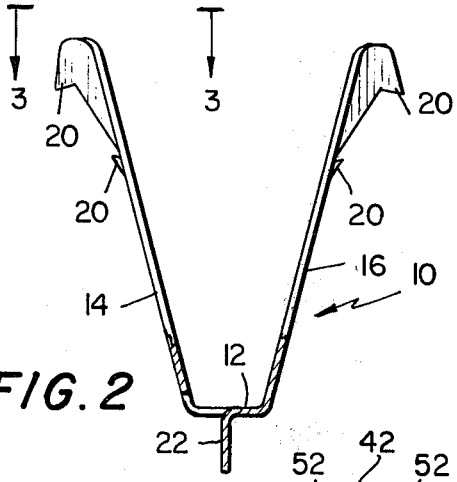
FIG. 2
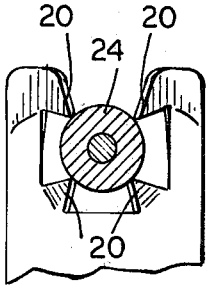
FIG. 5
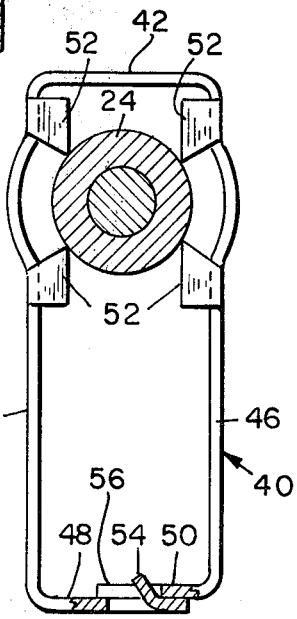
FIG. 6
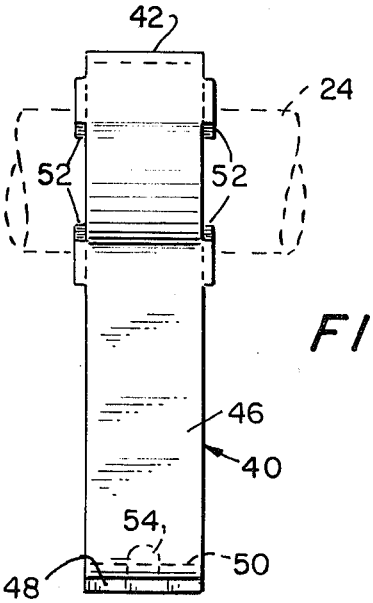
FIG. 7

SUPPORT LEG FOR THE BAKE ELEMENT OF AN ELECTRIC OVEN

This is a continuation of application Ser. No. 595,536, filed July 14, 1975, now abandoned.

BACKGROUND OF THE INVENTION

This invention relates to electric ovens, and more particularly to a support leg for the bake heating element thereof.

Support legs for the bake heating element of an electric oven are generally permanently mounted to the element in a manner which requires replacement of the element in the event of such a part failure. For example, in U.S. Pat. Nos. 2,918,560 and 3,154,669 to Kruse and Binder, respectively, the support legs are permanently mounted about the heating element. During normal operation, the sheath expansion contraction cycle at oven temperatures exerts a spreading force during a cooking cycle which overcomes the restraining force on current leg designs whereby such leg designs may be subjected thereafter to rotational movement.

OBJECTS OF THE INVENTION

An object of the present invention is to provide a novel leg support for the bake heating of an electric oven.

Another object of the present invention is to provide a novel leg support for the bake heating of an electric oven which may readily be replaced in a facile manner.

Still another object of the present invention is to provide a novel leg support for the bake heating of an electric oven which is able to maintain its grip about the heating element after being repeatedly subjected to self-cleaning temperatures.

SUMMARY OF THE INVENTION

There is provided a support leg for a heating element of an electric unit including vertically extending arm members including inwardly extending teeth members which firmly engage the outer surface of the heating element in a manner to prevent subsequent rotation of such support leg. The support leg of the present invention may be readily mounted on a bake heating element using readily available household tools as more fully hereinafter described.

BRIEF DESCRIPTION OF THE DRAWINGS

A better understanding of the present invention as well as other objects and advantages thereof will become apparent upon consideration of the detailed disclosure thereof, especially when taken with the accompanying drawings, wherein like numerals designate like parts throughout; and wherein:

FIG. 1 is a front elevational view of one embodiment of the support leg of the present invention;

FIG. 2 is a side elevational view of the support leg of FIG. 1;

FIG. 3 is a partial top view of the support leg taken along the lines 3—3 of FIG. 2;

FIG. 4 is an isometric view of the support element initially mounted about a bake element;

FIG. 5 is a partial view of the support element fully mounted on the bake element;

FIG. 6 is a front elevational view of a preferred embodiment of a support let of the present invention; and FIG. 7 is a side elevational view of the support leg of FIG. 6.

DETAILED DESCRIPTION OF THE DRAWINGS

Referring to FIGS. 1 to 3, there is illustrated the support leg of the present invention, generally indicated as 10 comprised of a base portion 12 and upwardly extending right and left arm portions 14 and 16, each formed with a cruxiform slot 18 forming inwardly extending teeth members 20. In the embodiment illustrated in FIGS. 1 and 3, the teeth members 20 are at a 60° angle although it is understood that the teeth may be formed at any degree of angles, including a serrated circular slot.

For ease of assembly of the support leg 10 on a heating element the upper teeth members 20 are formed in an outwardly extending V-shaped manner (See FIG. 3), with the lower teeth members 20 being slightly extended in an outwardly direction. The bottom portion 12 is formed with a downwardly extending tab 22 for mounting in a detent or like area. It is generally undesirable to permit the leg support to contact the porcelain of the oven for penetrating of the porcelain would be effected within a short period of time as a result of the operation or temperatures involved.

The leg support, referring to FIG. 4, is readily mounted on a heating element 24, shown in phantom, by snapping the leg support 10 thereon and rotating the leg support 10 into proper alignment. Thereafter, the arm members 14 and 16 are caused to be moved parallel to each other with the upper portion of each arm member being subject to a sufficient clamping force to cause the teeth members 20 to conform generally to the parallelism of the arm members thereby securely fastening the support let 10 to the heating element 24 with sufficient force to instantly prevent the rotation of the support leg 10 about the heating element 24, as shown in FIG. 5.

Referring to FIGS. 6 and 7 illustrating another embodiment of a leg support of the present invention, there is provided a leg support element, generally indicated as 40, comprised of a top segment 42, vertically extending L-shaped arm portions 44 and 46 including inwardly extending segments 48 and 50, respectively. The arm portions are formed with teeth members 52 extending inwardly and perpendicular to the arm portions 44 and 46 for engagement with the heating element 24. The segments 48 is formed with an upwardly extending tab 54 which cooperated with a slot 56 formed in the segment 50 of the arm portion 46. Each arm portion 44 and 46 is formed with a stiffening rib as section 58 and 60, respectively, to minimize loosening of grip of the teeth members on the heating element after many hours of operation.

While the invention has been described in connection with several exemplary embodiments thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed is:

1. In combination, an electric heating element and a support leg for supporting said electric heating element within an electric heating unit the combination comprising a support member having a base; and first and second arm members extending generally perpendicularly upwardly from said base and generally parallel to each other, said arm members being formed with U-shaped openings receiving said electric heating element and including teeth members extending inwardly into said U-shaped openings and flaring outwardly from said arm members and fixedly positioning said electric heating element within said U-shaped openings of said arm members whereby said arm members are substantially parallel to each other and they engage said electric heating element and said teeth members are distorted to a plane substantially parallel to the plane of said arm members and said teeth members fixedly engage and hold said heating element within said U-shaped openings of said arm members.

2. The combination as defined in claim 1 wherein said base includes a downwardly extending tab member.

3. The combination as defined in claim 1 wherein said arm members are perpendicular to said heating element and comprise two arm portions.

* * * * *